United States Patent [19]

Schwarz et al.

[11] 4,253,095

[45] Feb. 24, 1981

[54] ALARM APPARATUS FOR DETECTING DISTURBANCE OR OTHER CHANGE OF CONDITION

[75] Inventors: Ray P. Schwarz, Dayton; Daniel R. Valentine, New Lebanon, both of Ohio

[73] Assignee: Freund Precision, Inc., Kettering, Ohio

[21] Appl. No.: 913,472

[22] Filed: Jun. 7, 1978

[51] Int. Cl.[3] ..... G08B 13/08; G08B 13/14

[52] U.S. Cl. ..... 340/691; 200/43; 310/321; 340/546; 340/689

[58] Field of Search ..... 340/689, 691, 384 E, 340/546, 571, 63; 310/321, 317; 200/43

[56] References Cited

U.S. PATENT DOCUMENTS

| | | | |
|---|---|---|---|
| Re. 28,745 | 3/1976 | Smith | 340/384 E |
| 2,146,271 | 2/1939 | Schafer | 340/63 |
| 2,517,619 | 8/1950 | Ainley | 340/63 |
| 3,277,465 | 10/1966 | Potter | 340/384 E |
| 3,331,970 | 7/1967 | Dundon et al. | 310/321 |
| 3,514,556 | 5/1970 | LaFrance | 200/43 |
| 3,725,896 | 4/1973 | Wagner | 340/689 |
| 3,728,675 | 4/1973 | Horn et al. | 340/571 |
| 3,838,418 | 9/1974 | Brown | 340/384 E |
| 4,100,543 | 7/1978 | Stockdale et al. | 340/384 E |
| 4,104,628 | 8/1978 | Sweany et al. | 340/384 E |
| 4,112,267 | 9/1978 | Zangrando | 200/43 |
| 4,122,437 | 10/1978 | Peterson | 340/384 E |

*Primary Examiner*—Glen R. Swann, III

*Attorney, Agent, or Firm*—Jacox & Meckstroth

[57] ABSTRACT

A compact portable housing encloses a piezoelectric element which receives short pulses from a pulse generator circuit controlled by a ramping waveform generator circuit so that the element and the adjacent speaker portion of the housing produce a frequency modulated loud sweeping sound. The housing also encloses a detector switch for sensing a disturbance, and the sensitivity of the switch may be adjusted according to the position of the housing. The detector switch actuates a timer circuit which is armed or disarmed by moving a combination code switch having code wheels projecting from the housing.

6 Claims, 8 Drawing Figures

VA
VB
VEN
100
102
104
110
111
112
116
120
122
124
126
128
130
132
134
136
138
140
142
144
146
148
150
152
154
156
158
164
166
170
172
174
176
178
180
182
184
186
190
192
194
196
198
201
202
204
206
208
210
212
214
216
218
220
222
34
44
55
66
67
85
87
88

ALARM APPARATUS FOR DETECTING DISTURBANCE OR OTHER CHANGE OF CONDITION

BACKGROUND OF THE INVENTION

There have been proposed or constructed a number of audible noise makers or devices which incorporate piezoelectric elements along with various means for exciting the elements to generate noise from the elements. For example, U.S. Pat. Nos. 3,277,465, 3,331,970, 3,341,841, 3,569,963, 3,879,726, 3,912,952, 3,922,672 and 4,023,162 each discloses a form of buzzer or noise maker incorporating a piezoelectric crystal or element. However, in the design of any such device or apparatus which is adapted to be used as an alarm to signal an intrusion or fire or other disturbance, it is highly desirable for the device to produce its maximum volume sound output. For some applications, it is also desirable for the device to be of simple, compact, portable and inexpensive construction as well as dependable in operation. It is also commonly understood that piezoelectric crystals or elements are most efficient when operated at their resonant frequency.

SUMMARY OF THE INVENTION

The present invention is directed to an improved alarm device or apparatus which incorporates a piezoelectric transducer or element excited or driven in a manner which provides for substantially exceeding the maximum recommended voltage and power ratings for the element without damage to the element so that the element produces a penetrating sound of very high intensity. Preferably, the piezoelectric element is driven or excited by a solid state pulse generator circuit which is controlled by a solid state "ramping" waveform generator so that the emitted sound pulses vary in frequency according to the waveform. The alarm apparatus of the invention further provides for a compact portable housing having a speaker portion constructed to control the sound pulsations emitted by the piezoelectric element in a manner which further amplifies the sweeping pulses or sound output.

The alarm device of the invention also provides for a simplified and inexpensive combination code switch system which permits convenient selection of a predetermined code to activate and deactivate the device, and further provides for a disturbance detector switch which may be adjusted for sensitivity. The device also utilizes a solid state timing circuit to provide for predetermined short time delays after activating or arming the device and after moving or disturbing the device so that the alarm is not actuated by the person using the device.

Other features and advantages of the invention will be apparent from the following description, the accompanying drawings and the appended claims.

DESCRIPTION OF THE PREFERRED EMBODIMENT

Figure 1:
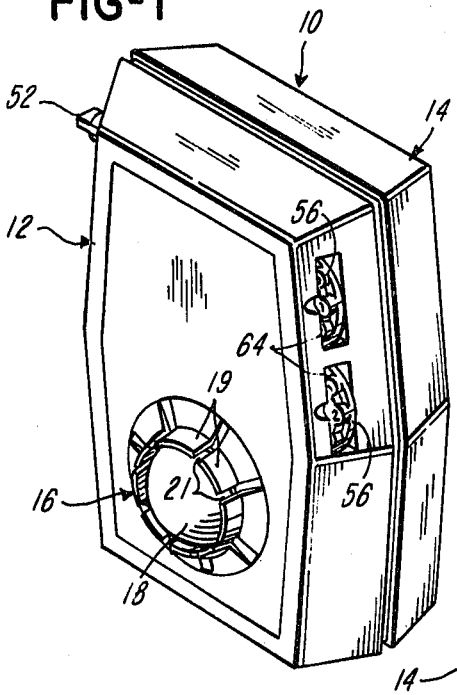
FIG. 1 is a perspective view of a portable motion detecting alarm device constructed in accordance with the invention.

The alarm apparatus or unit illustrated in FIG. 1 is adapted for use in sensing a slight movement or disturbance of the unit after the unit is armed. For example, the unit may be used to protect a handbag or briefcase which is not being used or for detecting an intruder into a motel room or motor vehicle or the disturbance of a parked bicycle or motorcycle. The device includes a housing 10 which is formed by two mating sections, a front section 12 and a rear section 14 each molded of a rigid plastics material.

Figure 3:
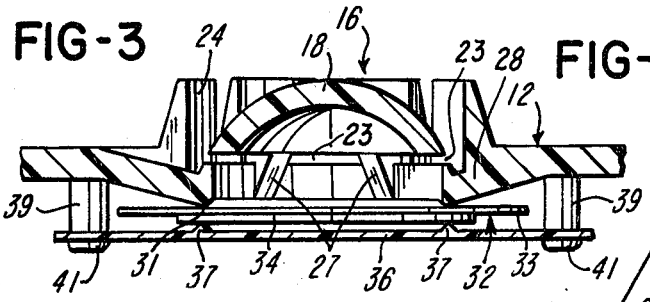
FIG. 3 is an enlarged cross-section of the housing and illustrating the assembly of the piezoelectric element adjacent the speaker portion of the housing.

The front section 12 includes a speaker portion 16 (FIGS. 1 & 3) formed by a domed-shaped wall 18 surrounded by a circular wall 19 which is interrupted by circumferentially spaced radial slots 21. The dome-shaped wall 18 is interrupted by peripherally spaced slots 23 which extend radially through the wall 18 and normally to the cylindrical inner surface 24 of the interrupted circular wall 19. The slots 23 are interrupted by cimcumferentially spaced tapered ribs 27 which project inwardly from a surrounding wall 28. The wall 28 has an inner frustro-conical surface which merges with the inner surface of the dome-shaped wall 18 to form a circular or annular seat 31.

Figure 2:
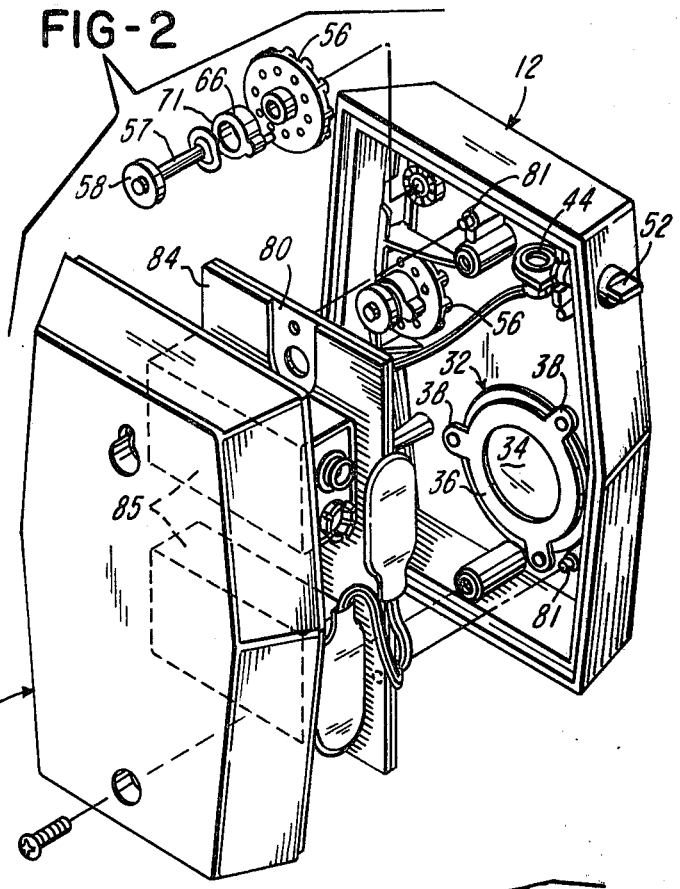
FIG. 2 is a perspective partially exploded view of the device shown in FIG. 1.

A piezoelectric transducer 32 (FIG. 3) includes a metal or brass disc 33 which is adhesively bonded to a piezoeletric disc or element 34. The metal disc 33 is held firmly against the circular seat 31 by an annular retaining member 36 (FIG. 2) having diametrically opposed arcuate ribs 37 (FIG. 3) engaging the piezoelectric element 34. The retaining member 36 has a set of peripherally spaced ears 38 (FIG. 2) which have holes for receiving corresponding shouldered studs 39 molded as part of the front housing section 12. After the ears 38 are mounted on the studs 39, the outer end portions of the studs 39 are enlarged to form the securing head portions 41.

Figure 5:
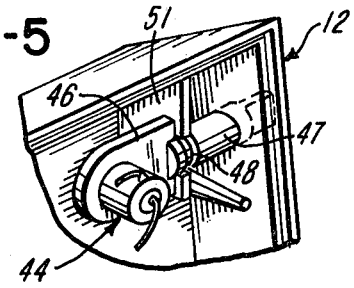
FIG. 5 is a fragmentary perspective view of the device and showing the motion sensing element in a second position.

The front housing section 12 also supports a motion or disturbance detector switch 44 (FIGS. 2 and 5) which is in the form of a mercury sensing or tilt switch which is pressed into a hole formed within the inner spade-like portion 46 of a molded plastic rotary sensitivity control member or stem 47. The stem 47 has a circumferential groove 48 which receives a web 51 molded as part of the front housing section 12 and is retained by a snap-fit assembly. The stem 47 also projects through an opening within the housing section 12 and has an outer end portion 52 (FIG. 2) adapted to be gripped by the fingers for rotating the switch 44 through an angle of approximately 90 degrees when the portion 46 engages stops for selecting the sensitivity of the switch according to the position of the alarm device or unit 10.

The front housing section 12 further incorporates a combination code switch assembly 55 (FIG. 4) which includes a pair of rotary dials or thumb wheels 56 mounted for rotation on corresponding shafts 57. Each of the shafts 57 includes an integral circular head portion 58 and projects through a center bore within the corresponding thumb wheel 56 and is pressfitted into a corresponding blind hole 59 formed within the housing section 12. Each hole 59 is surrounded by V-shaped teeth 61 which mate with corresponding teeth 62 molded on the thumb wheel 56 to form positive rotary detent when the thumb wheel 56 is rotated by turning a peripherial portion of the thumb wheel projecting through a corresponding slot or window 64 (FIG. 1) within the housing section 12.

Figure 4:
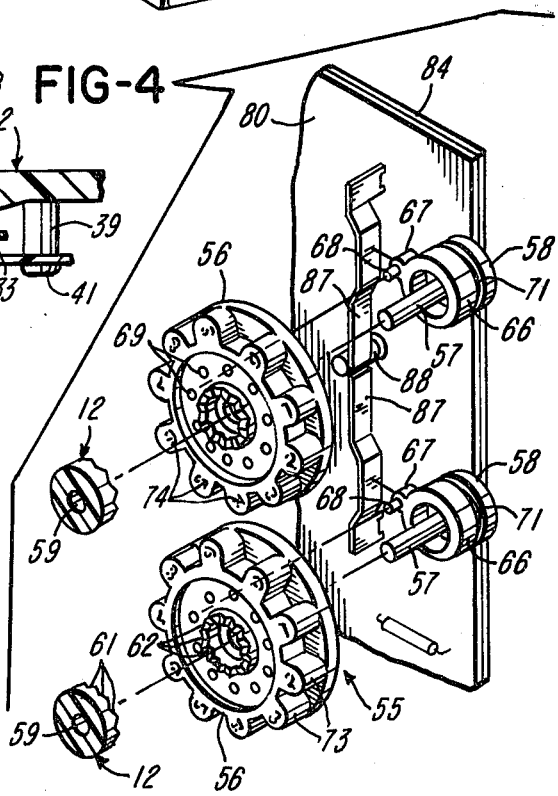
FIG. 4 is an enlarged fragmentary exploded perspective view of the combination code switch mechanism.

Each of the thumb wheel 56 also includes annular collar 66 having a protrusion 67. A pin 68 projects axially from the protrusion 67 of each collar 66 and is received within one of the circumferentially spaced holes 69 formed within the thumb wheel 56 so that the collar rotates with the thumb wheel. A wave-type spring washer 71 is confined between each collar 56 and the adjacent head portion 58 of the corresponding shaft 57 for biasing the teeth 62 into resilient engagement with the teeth 61 to form the rotary detent action when the thumb wheel is rotated. As shown in FIG. 4, each of the thumb wheels 56 has peripherially spaced bumps or projections 73 which carry a series of numbers 74, preferably 1 through 0.

A printed circuit board 80 carries the circuit components for operating the alarm unit, as will be explained later, and is mounted on a set of three support posts 81 molded as a part of the front housing section 12. After the circuit board 80 is mounted on the post 81, the outer end portions of the post are enlarged to form an integral rivet. The circuit board 80 is covered by an electrical insulating sheet 84, and a pair of batteries 85 are positioned within the rear housing section 14 adjacent the circuit board 80 to provide the power supply. For example, each of the batteries 85 has a 9 volt rating, and the batteries are connected in series to provide an 18 volt power supply.

As shown in FIG. 4, the combination code switch assembly 55 also includes a set of spring leaf-type switch elements 87 which are supported by the circuit board 80 adjacent the paths of the protrusions 67 on the rotary collar 66. When the thumb wheels 56 are rotated to positions where the protrusions 67 engage the switch elements 87, the elements contact a metal post 88 projecting from the circuit board 80 so that the switch elements 87 are connected in series to form a continuous conductor. When both switch elements 87 are urged against the post 88, the numbers appearing on the portions of the thumb wheels 56 within the windows 64 show the code which will place the alarm unit in an inactive condition. When either one or both of the code wheels are rotated or indexed from the inactive or "off" position, the continuity of the switch elements 87 is interrupted to open the circuit.

Figures 6, 7, 8:
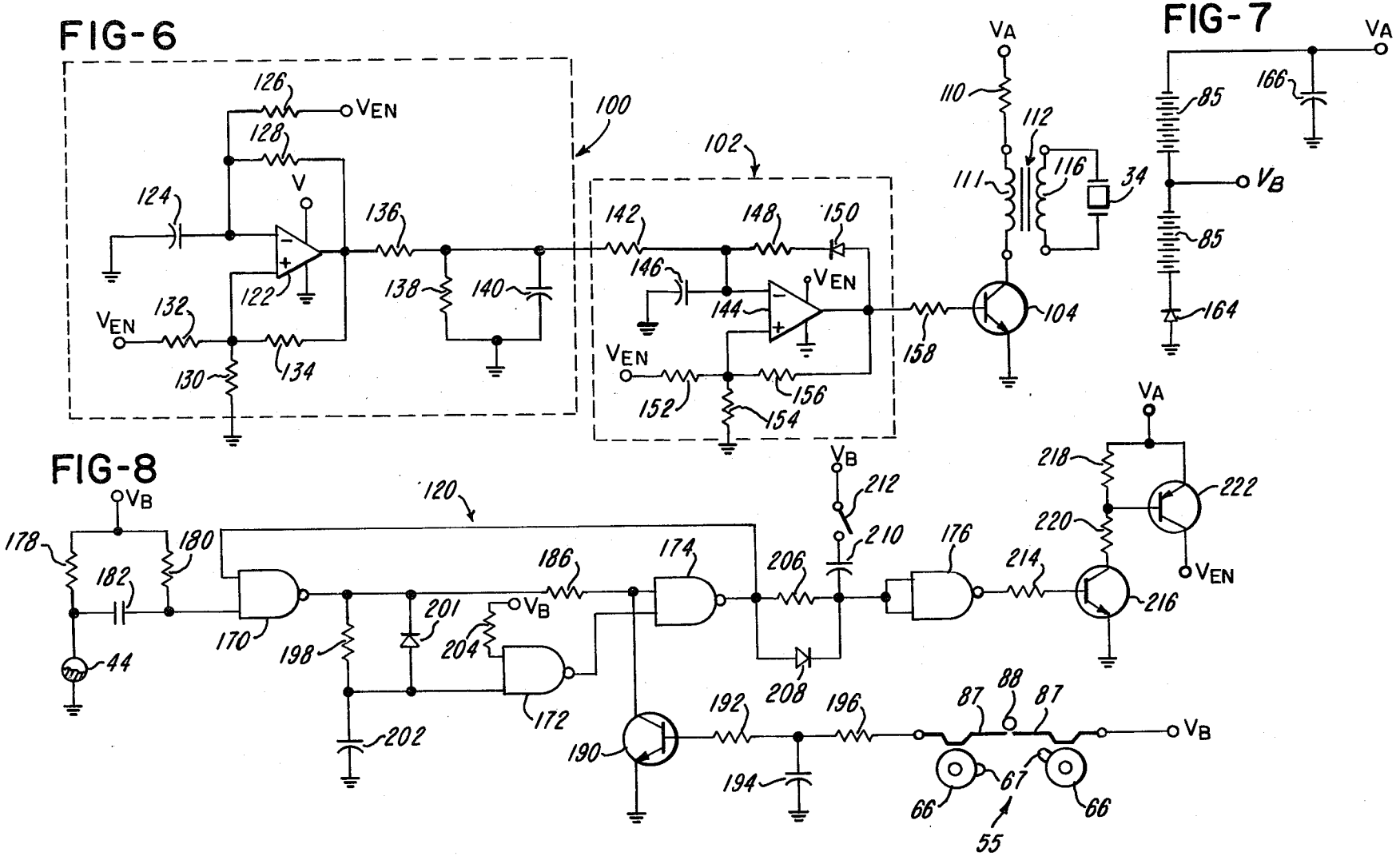
FIGS. 6, 7 and 8 illustrate the diagrammatic circuits for controlling and operating the alarm device shown in FIGS. 1-4.

Referring to FIGS. 6, 7 and 8 which show the circuitry for operating the unit or exciting the piezoelectric element 34, a "ramp" waveform generator circuit 100 and a pulse generator circuit 102 are connected as shown in FIG. 6. The pulse generator circuit 102 delivers pulses to the base of a switching transistor 104 which, in response, causes current to flow from a voltage source $V_A$ through a resistor 110, a primary coil 111 of a transformer 112, and the transistor 104 to ground. As will be more fully described later, the pulses delivered to the base of transistor 104 are relatively short. As a result, short "spikes" of current flow through the primary coil 111 and induce a relatively high, somewhat sinusoidal voltage across the secondary coil 116 of the transformer, which in turn, energizes or excites the piezoelectric element 34. The waveform generator circuit 100 and pulse generator circuit 102 are each powered by an enabling voltage $V_{EN}$ provided by an alarm control or trigger circuit 120 which will be described later with reference to FIG. 8.

Referring again to FIG. 6, the waveform generator 100 includes an operational amplifier 122 powered by the voltage $V_{EN}$. The negative input terminal of operational amplifier 122 is connected to ground through a capacitor 124, to the voltage $V_{EN}$ through a resistor 126, and to the output of the operational amplifier by a feedback loop having a resistor 128. The positive input terminal of the operational amplifier 122 is connected to ground through a resistor 130, to the voltage $V_{EN}$ by a resistor 132 and to the output of the operational amplifier by a feedback loop having a resistor 134.

The output of operational amplifier 122 is in the form of square pulses having a preferred frequency of approximately 2 Hz. The pulses are applied to an RC network comprised of two resistors 136 and 138 and a capacitor 140 so that the output of the waveform generator 100 is in the form of periodic, non-linearly increasing ramps, having a frequency of 2 Hz.

The pulse generator circuit 102 generates pulses having a width of approximately 50 microseconds, with the frequency of the pulses determined by the amplitude of the signal delivered to its input at a resistor 142. Accordingly, when the periodic non-linear ramps generated by the waveform generator circuit 100 are supplied, the output of the pulse generator circuit is a series of short pulses increasing in frequency and repeating twice per second. In the preferred embodiment, each series of pulses increases from about 400 to 4000 Hz. to provide the desired sweeping sound mentioned above.

The pulse generator circuit 102 includes an operational amplifier 144 which is also powered by the voltage $V_{EN}$. The negative input terminal of the operational amplifier 144 is connected to the output of the waveform generator circuit 100 through the resistor 142, to ground through a capacitor 146, and to the output of operational amplifier 144 by a feedback loop having a resistor 148 and a diode 150. The positive input terminal of the operational amplifier 144 is connected to the voltage $V_{EN}$ through a resistor 152, to ground through a resistor 154, and to the output of the operational amplifier through a feedback loop having a resistor 156. The output of the operational amplifier 144 is connected to the base of the switching transistor 104 through a resistor 158. The operational amplifiers 122 and 144 are conventional, such as those found on a single integrated circuit chip No. LM358, sold by National Semiconductor Corp. of Santa Clara, California.

FIG. 7 illustrates the battery system for the circuitry illustrated in FIGS. 6 and 8, and includes the two serially connected batteries 85. The negative terminal of one battery 85 is connected to ground through a diode 164 and a tap between the series connected batteries provides a voltage $V_B$. The positive terminal of the other battery 85 provides the above mentioned voltage $V_A$. The positive terminal providing $V_A$ is connected to ground through a capacitor 166 which is sufficiently charged by the batteries to provide the current spikes which pass through the primary coil 111 of transformer 112. As mentioned above, the batteries 85 in the perferred embodiment are each 9 volt D. C. dry cell batteries, and accordingly, $V_A$ is approximately 18 volts, and $V_B$ is approximately 9 volts.

FIG. 8 illustrates the alarm trigger circuit 120 which provides the voltage $V_{EN}$ to enable the waveform generator and pulse generator circuits 100 and 102. The alarm trigger circuit includes four NAND gates 170, 172, 174 and 176. An RC network including two resistors 178 and 180 and a capacitor 182 connect one input of gate 170 to the voltage $V_B$ and also to ground by way of the mercury detector switch 44. This one input is high or at a "1" logic level when mercury switch 44 is open, and is initially low or at a "0" logic level when the mercury switch 44 is closed, such as when the alarm device 10 is disturbed. The other input of gate 170 is connected to the output of gate 174.

The output of gate 170 is connected by way of resistor 186 to an input of gate 174. The same input of gate 174 is also connected to ground by a switching transistor 190. The base of the transistor 190 is connected to one side of the combination code switch 55 by an RC network including a resistor 192, a grounded capacitor 194 and a resistor 196. The other side of the combination switch 55 is connected to the voltage $V_B$.

The output of gate 170 is also connected to one input of the gate 172 by a paralleled resistor 198 and diode 201. The same input of gate 172 is also connected to ground by a capacitor 202. The other input of gate 172 is connected to the voltage $V_B$ by a resistor 204 and thus always remains high or at a "1" logic level. The output of gate 172 is connected to an input of gate 174. The output of gate 174 determines whether the enabling voltage $V_{EN}$ is provided by the alarm trigger circuit 120. For reasons which will be described later, when the output is at a "0" logic level, $V_{EN}$ is provided, and when the output is at a "1" level, $V_{EN}$ is not provided.

When the combination switch 55 is closed, transistor 190 is made conductive and one of the inputs to gate 174 is grounded and at a "0" logic level. When the combination switch is opened, the transistor 190 remains conductive for a short period of time while the capacitor 194 discharges. This short period of delay gives time, for example ten seconds, for one to place the alarm device 10 in a desired location before closure of the mercury switch 44 will cause the piezoelectric element to be energized. After this short time, the one input to gate 174 is no longer grounded.

If at that time the mercury switch 44 is closed, the input of gate 170 connected to capacitor 182 is initially at ground, and the output of gate 170 goes to a "1" state. Until such time that capacitor 202 charges, the output of gate 172 is also at a "1" state, and thus the output of gate 174 goes to a "0" and the piezoelectric element 34 is excited. The "0" at the output of gate 174 is fed back to one input of gate 170 whose output is then latched at a "1", regardless of any subsequent condition of mercury switch 44. After a predetermined period of time, the capacitor 202 charges so that a sufficiently positive voltage is presented to the input of gate 172, causing its output to go to "0". The output of gate 174 then returns to "1", and the piezoelectric element 34 is no longer excited.

It can thus be seen that the latching of gate 170 causes the enabling voltage $V_{EN}$ to be provided when mercury switch 44 senses a single or momentary disturbance, and that capacitor 202 causes the enabling voltage to be provided for only a predetermined period of time, for example, ninety seconds in order to preserve the batteries 85.

As also shown in FIG. 8, the output of gate 174 is connected by a paralleled resistor 206 and diode 208 to the inputs of gate 176 which acts as an inverter. The inputs of gate 176 are also connected by a capacitor 210 and a delay switch 212 to the voltage $V_B$. When delay switch 212 is closed and the output of gate 174 goes to "0", the inputs to gate 176 remain high until the capacitor 210 charges. When the delay switch is opened, a "0" at the output of gate 174 is presented to gate 176 without any significant delay. In this manner, the delay switch 212 permits one to select whether the piezoelectric element will be excited immediately or after a short delay when the mercury switch 44 is closed.

The output of gate 176 is connected by a resistor 214 to the base of a switching transistor 216. When the output of gate 174 goes to "0", the output of gate 176 goes to "1", and transistor 216 is energized. Current then flows from voltage $V_A$ through a resistor 218, a resistor 220, and the transistor 216 to ground, and the resulting voltage across resistor 220 energizes a switching transistor 222. Energized transistor 222 supplies the enabling voltage $V_{EN}$ in order to enable the waveform generator circuit 100 and pulse generator circuit 102 and thereby excite the piezoelectric element 34 in the manner described earlier.

From the drawings and the above description, it is apparent that the alarm device of the invention provides all of the desirable features and advantages mentioned above.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for producing a loud audible alarm is response to a distrubance, comprising a piezoelectric element, means for exciting said element, a motion detector switch for sensing a disturbance a pulse generator circuit for supplying short electrical pulses to said exciting means, a ramp waveform generator circuit connected to control the frequency of the electrical pulses of said pulse generator circuit to produce a sweeping sound from said element, a control circuit for actuating said pulse generator and waveform generator circuits in response to the sensing of a disturbance by said detector switch, a housing enclosing said piezoelectric element, exciting means, detector switch, pulse generator circuit, ramp waveform generator circuit and control circuit, a combination control switch including a plurality of rotary code wheels arranged in tandem relation and having portions projecting from said housing, means supporting said code wheels for independent rotation on parallel axes, a flexible contact element for each of said code wheels, a rotary actuator supported for rotation with each said code wheel, said actuators projecting axially from said code wheels and having means for flexing the corresponding said contact elements and for deactuating said control circuit in response to rotating all of said code wheels to corresponding predetermined code positions, and battery means within said housing for supplying power to said piezoelectric element.

2. Apparatus as defined in claim 1 including means for adjusting the circumferential position of said actuator relative to the corresponding said code wheel.

3. Apparatus for producing a loud audible alarm in response to a disturbance or other change of condition, comprising a piezoelectric element, detector means for sensing a disturbance, a pulse generator connected for supplying short electrical pulses to energize said piezoelectric element, a waveform generator connected to control said pulse generator for varying the frequency of the pulses supplied by said pulse generator to produce a frequency modulated sweeping sound from said element, a control circuit for actuating said waveform generator and pulse generator to produce varying frequency pulses in response to the sensing of a disturbance, a housing enclosing said piezoelectric element, said detector means, said pulse and waveform generators and said control circuit, said housing including a speaker portion having a cup-shaped wall portion defining a chamber adjacent said piezoelectric element, a plurality of peripherally spaced and generally coplanar openings within said wall portion, and wall means disposed around said wall portion and forming a surface spaced radially outwardly from said openings and opposing said openings.

4. Apparatus as defined in claim 3 wherein said wall means comprise a generally circular wall having circumferentially spaced gaps, and said openings comprise slots.

5. Apparatus as defined in claim 3 wherein said housing includes a front section and a rear section coupled together, said front housing section including said speaker portion, and said rear section enclosing said battery means for supplying power to said piezoelectric element.

6. Apparatus for producing a loud audible alarm in response to a disturbance, comprising a piezoelectric element, means for exciting said element, a motion detector switch for sensing a disturbance, a pulse generator circuit for supplying short electrical pulses to said exciting means, a ramp waveform generator circuit connected to control the frequency of the electrical pulses of said pulse generator circuit to produce a sweeping sound from said element, a control circuit for actuating said pulse generator and waveform generator circuits in response to the sensing of a disturbance by said detector switch, said control circuit including timing means for causing an enabling signal to be provided to said pulse generator and waveform generator circuits for a predetermined period of time after a single disturbance is sensed by said detector switch, a housing enclosing said piezoelectric element, exciting means, detector switch, pulse generator circuit, ramp waveform generator circuit and control circuit, said housing including a speaker portion having a cup-shaped wall portion defining a chamber adjacent said piezoelectric element, a plurality of peripherally spaced and generally coplanar openings within said wall portion, wall means spaced radially outwardly from said openings and opposing said openings, a combination control switch including a plurality of rotary code wheels having portions projecting from said housing, said control switch having means for deactuating said control circuit in response to rotating all of said code wheels to corresponding predetermined code positions, and battery means within said housing for supplying power to said piezoelectric element.

* * * * *

UNITED STATES PATENT AND TRADEMARK OFFICE

CERTIFICATE OF CORRECTION

PATENT NO. : 4,253,095

DATED : February 24, 1981

INVENTOR(S) : Ray P. Schwarz and Daniel R. Valentine

It is certified that error appears in the above-identified patent and that said Letters Patent are hereby corrected as shown below:

Claim 1, column 6, line 36, cancel "is" and insert -- in -- .

Signed and Sealed this

*Sixteenth* Day of *June 1981*

[SEAL]

*Attest:*

RENE D. TEGTMEYER

*Attesting Officer*

*Acting Commissioner of Patents and Trademarks*